US010006287B2

(12) United States Patent
Ignatiev et al.

(10) Patent No.: US 10,006,287 B2
(45) Date of Patent: Jun. 26, 2018

(54) COMPRESSOR SHELL ASSEMBLY

(71) Applicant: Emerson Climate Technologies, Inc., Sidney, OH (US)

(72) Inventors: Kirill M. Ignatiev, Sidney, OH (US); John Sheridan, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 324 days.

(21) Appl. No.: 14/875,294

(22) Filed: Oct. 5, 2015

(65) Prior Publication Data

US 2016/0115955 A1 Apr. 28, 2016

Related U.S. Application Data

(60) Provisional application No. 62/069,585, filed on Oct. 28, 2014.

(51) Int. Cl.

| | |
|---|---|
| ***F04B 1/12*** | (2006.01) |
| ***F04C 18/02*** | (2006.01) |
| ***F01C 21/10*** | (2006.01) |
| *F04C 23/00* | (2006.01) |

(52) U.S. Cl.

CPC ..... *F01C 21/10* (2013.01); *F04C 18/0215* (2013.01); *F04C 23/008* (2013.01)

(58) Field of Classification Search

CPC ..... F01C 21/10; F04B 39/121; F04C 23/008; F04C 27/008

See application file for complete search history.

(56) References Cited

U.S. PATENT DOCUMENTS 2,381,585 A * 8/1945 Gambrell ..... F02M 59/04 417/269

4,684,837 A 8/1987 Schaefer et al.

(Continued)

FOREIGN PATENT DOCUMENTS

CN 1328215 A 12/2001
CN 1666021 A 9/2005

(Continued)

OTHER PUBLICATIONS

Office Action regarding Chinese Patent Application No. 201510700688.9, dated May 3, 2017. Translation provided by Unitalen Attorneys at Law.

(Continued)

*Primary Examiner* — Mark Laurenzi
*Assistant Examiner* — Anthony Ayala Delgado
(74) *Attorney, Agent, or Firm* — Harness, Dickey & Pierce, P.L.C.

(57) ABSTRACT

A compressor may include a compression mechanism and a shell assembly. The shell assembly may include a body and first and second end caps cooperating to contain the compression mechanism within the body. The body may include first and second open ends and inner and outer surfaces extending between the first and second ends. The outer surface may include first and second threaded portions disposed near the first and second ends, respectively. The first end cap may include a side wall having a third threaded portion engaging said first threaded portion of said body. The second end cap may include a side wall having a fourth threaded portion engaging the second threaded portion of the body.

21 Claims, 4 Drawing Sheets

(56) References Cited

U.S. PATENT DOCUMENTS

| | | | | |
|---|---|---|---|---|
| 5,431,547 | A | 7/1995 | Boyko | |
| 5,456,161 | A | 10/1995 | Yuda et al. | |
| 6,152,715 | A * | 11/2000 | Kaempe | F01C 21/10 418/132 |
| 6,857,863 | B1 | 2/2005 | Modrzejewski et al. | |
| 7,004,729 | B2 * | 2/2006 | Weber | F04B 27/1081 417/222.1 |
| 7,836,817 | B2 | 11/2010 | Tokumoto | |
| 9,850,901 | B2 | 12/2017 | Ignatiev et al. | |
| 2003/0194331 | A1 * | 10/2003 | Pitla | F04B 27/1081 417/360 |

FOREIGN PATENT DOCUMENTS

| | | | |
|---|---|---|---|
| CN | 101220822 | A | 7/2008 |
| CN | 101349260 | A | 1/2009 |
| CN | 102720672 | A | 10/2012 |
| CN | 103375394 | A | 10/2013 |
| CN | 205388005 | U | 7/2016 |
| CN | 205401051 | U | 7/2016 |
| JP | 2010090789 | A | 4/2010 |

OTHER PUBLICATIONS

Office Action regarding U.S. Appl. No. 14/875,100, dated Feb. 21, 2017.

Office Action regarding Chinese Patent Application No. 201510708105.7, dated Jun. 1, 2017. Translation provided by Unitalen Attorneys at Law.

Office Action regarding Chinese Patent Application No. 201510700688.9 dated Jan. 3, 2018. Translation provided by Unitalen Attorneys at Law.

* cited by examiner

COMPRESSOR SHELL ASSEMBLY

CROSS-REFERENCE TO RELATED APPLICATIONS

This application claims the benefit of U.S. Provisional Application No. 62/069,585, filed on Oct. 28, 2014. The entire disclosure of the above application is incorporated herein by reference.

FIELD

The present disclosure relates to a compressor, and more particularly, to a compressor shell assembly.

BACKGROUND

This section provides background information related to the present disclosure and is not necessarily prior art.

To provide a heating and/or cooling effect, a compressor may be used in a refrigeration, heat pump, HVAC, or chiller system (generically, "climate control system") to circulate a working fluid therethrough. The compressor may be one of a variety of compressor types. For example, the compressor may be a scroll compressor, a rotary-vane compressor, a reciprocating compressor, a centrifugal compressor, or an axial compressor. Regardless of the exact type of compressor employed, consistent and reliable construction and assembly of the compressor shell assembly is desired to ensure that the compressor can effectively circulate the working fluid through the climate control system.

SUMMARY

This section provides a general summary of the disclosure, and is not a comprehensive disclosure of its full scope or all of its features.

In one form, the present disclosure provides a compressor that may include a compression mechanism and a shell assembly. The shell assembly may house the compression mechanism and may include a body, an end cap, and a collar. The end cap may engage the body and the collar may restrict separation of the end cap and the body.

In some configurations, the body may include outer and inner surfaces extending between first and second ends of the body. A fastener may engage the collar and a first aperture disposed through the outer surface.

In some configurations, the end cap may include a first threaded portion matingly engaging a second threaded portion disposed on the outer surface of the body.

In some configurations, the collar may be integrally formed with the end cap and may include a second aperture through which the fastener extends.

In some configurations, the collar may include a shoulder engaging the end cap and a threaded portion engaging a threaded portion disposed on the outer surface of the body.

In some configurations, the end cap may include an annular protrusion having a first surface and an oppositely located second surface. The shoulder of the collar may engage the first surface, and the second surface may engage the first end of the body.

In some configurations, the end cap may include a side surface partially received within the first end of the body and an annular protrusion extending radially outward from the side surface.

In some configurations, the side surface may include an annular groove receiving an O-ring seal therein.

In some configurations, the collar may include a second aperture. The fastener may engage the second aperture of the collar and the first aperture disposed through the outer surface of the body.

In some configurations, an O-ring seal may be disposed between the end cap and the body.

In some configurations, the end cap may include an outer wall having a discharge fitting extending therethrough.

In another form, the present disclosure provides a compressor that may include a compression mechanism and a shell assembly. The shell assembly may include a body and first and second end caps cooperating to contain the compression mechanism within the body. The body may include first and second open ends and inner and outer surfaces extending between the first and second ends. The outer surface may include first and second threaded portions disposed near the first and second ends, respectively. The first end cap may include a side wall having a third threaded portion engaging the first threaded portion of the body. The second end cap may include a side wall having a fourth threaded portion engaging the second threaded portion of the body.

In some configurations, the side wall of the first end cap may include a first aperture. The outer surface of the body may include a second aperture disposed near the first end, and wherein a first fastener may engage the first and second apertures. The side wall of the second end cap may include a third aperture, the outer surface of the body may include a fourth aperture disposed near the second end, and wherein a second fastener may engage the third and fourth apertures.

In some configurations, the shell assembly may include first and second collars and first and second fasteners. The first collar may be coupled to the side wall of the first end cap and may include a first aperture. The outer surface of the body may include a second aperture disposed near the first end, and wherein the first fastener may engage the first and second apertures. The second collar may be coupled to the side wall of the second end cap and may include a third aperture. The outer surface of the body may include a fourth aperture disposed near the second end, and wherein the second fastener may engage the third and fourth apertures.

In some configurations, the shell assembly may include a first O-ring seal disposed between the first end cap and the body, and a second O-ring seal may be disposed between the second end cap and the body.

In some configurations, the first end cap may include an outer wall having a discharge fitting extending therethrough, and the second end cap may include an outer wall having a mounting base.

In yet another form, the present disclosure provides a compressor that may include a compression mechanism and a shell assembly. The shell assembly may include a body, first and second end caps, and first and second lock nuts cooperating with the first and second end caps to contain the compression mechanism within the body. The body may include first and second open ends and inner and outer surfaces extending between the first and second open ends. The outer surface may include a first threaded portion disposed near the first end and a second threaded portion disposed near the second end. The first end cap may include a side wall received within the first end of the body and may have a first protrusion engaging the first end. The first lock nut may include a first shoulder engaging the first protrusion of the first end cap and a third threaded portion engaging the first threaded portion of the body. The second end cap may include a side wall received within the second end of the body and may have a second protrusion engaging the second end. The second lock nut may include a second shoulder engaging the second protrusion of the second end cap and a fourth threaded portion engaging the second threaded portion of the body.

In some configurations, the side wall of the first and second end caps may include outer surfaces engaging the inner surfaces of the body. The outer surfaces of the first and second end caps may include grooves receiving O-ring seals therein.

In some configurations, the shell assembly may include first and second fasteners. The first lock nut may include a first aperture and the outer surface of the body may include a second aperture. The first fastener may engage the first and second apertures. The second lock nut may include a third aperture, and the outer surface of the body includes a fourth aperture. The second fastener may engage the third and fourth apertures.

In some configurations, the first end cap may include an outer wall having a discharge fitting extending therethrough, and the second end cap may include an outer wall having a mounting base.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
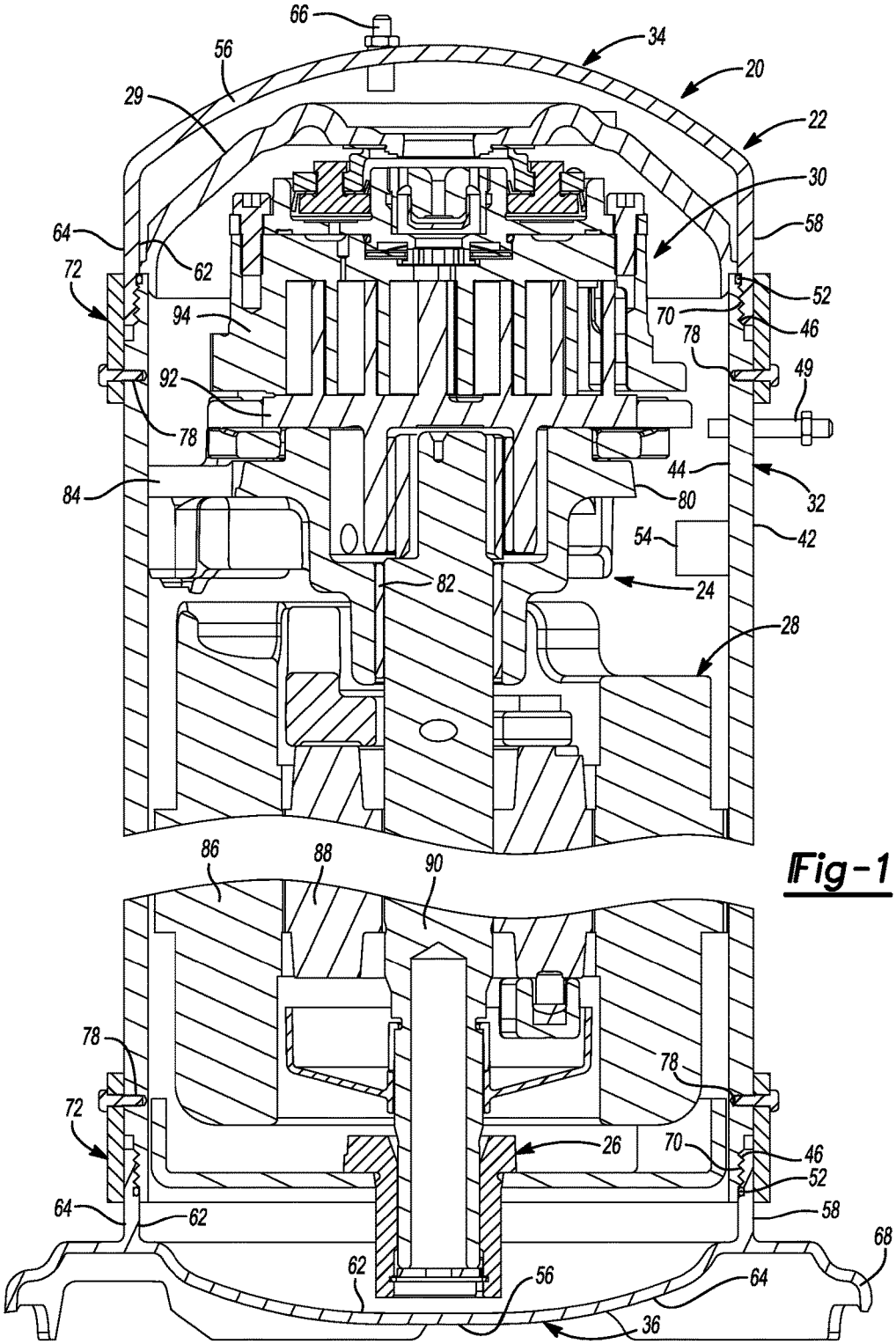
FIG. 1 is a cross-sectional view of a compressor including a compressor shell assembly according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 20 is provided that may include a compressor shell assembly 22, first and second bearing-housing assemblies 24, 26, a motor assembly 28, and a compression mechanism 30.

The compressor shell assembly 22 may form a compressor housing and may contain therein the first and second bearing-housing assemblies 24, 26, the motor assembly 28, and the compression mechanism 30. The compressor shell assembly 22 may include a body 32, a first end cap 34, and a second end cap 36.

Figure 2:
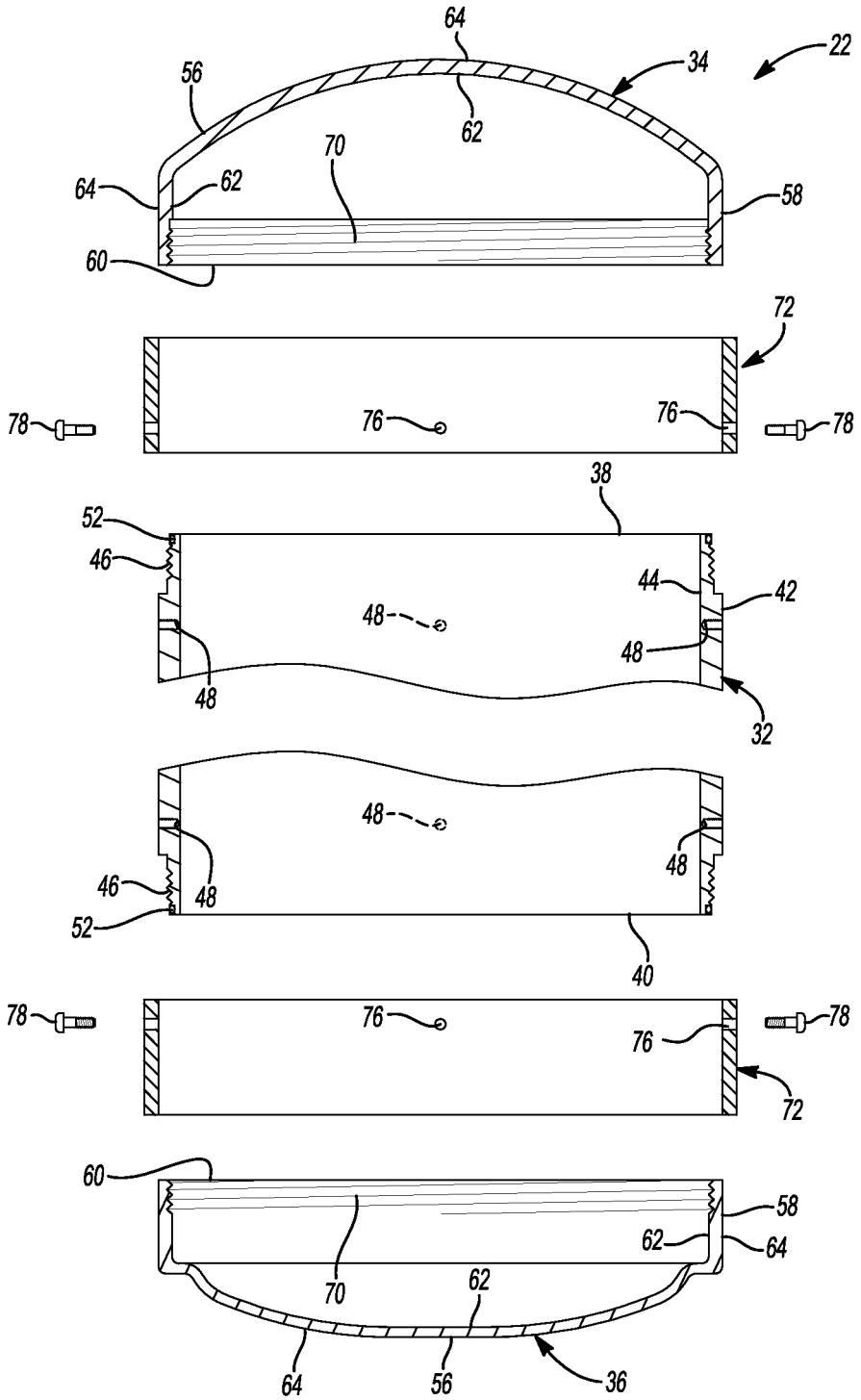
FIG. 2 is an exploded cross-sectional view of the compressor shell assembly of FIG. 1.

Referring now to FIGS. 1 and 2, the body 32 may be an annular member and may include a first end 38, a second end 40, and outer and inner surfaces 42, 44 extending longitudinally between the first and second ends 38, 40. The outer surface 42 of the body 32 may include a pair of threaded portions 46, at least one pair of alignment orifices 48, and an inlet fitting 49. Each threaded portion 46 may be located near a respective one of the first and second ends 38, 40. Elastomeric annular gaskets or O-ring seals 52 may engage the outer surface 42 of the body 32 and may be received within the threaded portions 46, and/or, may be received near the first and second ends 38, 40 of the body 32. Each alignment orifice 48 may be located near a respective one of the threaded portions 46 and may extend through the outer surface 42 of the body 32. The inlet fitting 49 may receive working fluid from a low side of a climate control system and communicate the working fluid to the compression mechanism 30.

The inner surface 44 of the body 32 may include features 54 (shown schematically in FIG. 1) that may be used for locating, aligning, and/or attaching various compressor components to the body 32. For example, the features 54 may include detents and/or protrusions engaging the bearing-housing assemblies 24, 26, the motor assembly 28 and/or a partition plate 29 that separates a suction-pressure region from a discharge-pressure region of the compressor 20.

The first and the second end caps 34, 36 may each include a first wall 56 closing an end of an annular side wall 58, and each wall 56, 58 may include an inner and outer surface 62, 64. An open end 60, generally defined by the annular side wall 58, may be located opposite the inner surface 62 of the first wall 56.

The first wall 56 of the first end cap 34 may include a discharge fitting 66 communicating working fluid discharged from the compression mechanism 30 to a high side of a climate control system into which the compressor 20 may be installed. In some configurations (e.g., configurations in which the compressor 20 is a high-side compressor), the first wall 56 or another portion of the first end cap 34 may include the inlet fitting 49. The first wall 56 of the second end cap 36 may include a base 68. The base 68 may be mounted to the first wall 56 or may be integrally formed therewith.

The annular side wall 58 of each end cap 34, 36 may include a threaded portion 70 and an alignment feature 72. The threaded portions 70 of the end caps 34, 36 may matingly engage the threaded portions 46 of the body 32. Each alignment feature 72 may be an annular collar, for example, and may receive therein the annular side wall 58 of each end cap 34, 36. The alignment feature 72 may be a bracket fastened to the side wall 58 of each end cap 34, 36 or the alignment feature 72 may be integrally formed with the side wall 58. Each alignment feature 72 may include an alignment orifice 76 that may be near or equivalent in size to each alignment orifice 48 disposed through the outer surface 42 of the body 32. Fasteners 78, such as bolts or screws, for example, may extend through the alignment orifices 76 and engage the alignment orifices 48.

The first bearing housing assembly 24 may be fixed relative to the body 32 and may include a main bearing-housing 80 and a main bearing 82. The main bearing-housing 80 may axially support the compression mechanism 30 and may house the main bearing 82 therein. The main bearing-housing 80 may also include a plurality of radially extending arms 84 engaging the body 32.

The motor assembly 28 may include a motor stator 86, a rotor 88, and a drive shaft 90. The motor stator 86 may be press fit into the body 32 to fix the stator 86 relative to the body 32. The drive shaft 90 may be rotatably driven by the rotor 88, which may be press fit onto the drive shaft 90. The drive shaft 90 may be rotatably supported by the first and second bearing-housing assembly 24, 26.

The compression mechanism 30 may include an orbiting scroll 92 and a non-orbiting scroll 94. The scrolls 92, 94 may meshingly engage one another to compress the working fluid circulating through the climate control system.

While the compressor 20 is described as being a scroll compressor, it will be appreciated that the compressor 20 may be any other type of compressor, such as a reciprocating compressor, a rotary-vane compressor, a centrifugal compressor, or an axial compressor, for example. Furthermore, while the compressor 20 shown in FIG. 1 is a low-side compressor (i.e., the motor assembly 28 and compression mechanism 30 are disposed in a suction-pressure region of the compressor 20), in some configurations, the compressor 20 could be a high-side compressor (e.g., wherein the motor assembly 28 and compression mechanism 30 are disposed in a discharge-pressure region of the compressor 20).

With continued reference to FIGS. 1 and 2, assembly of the compressor shell assembly 22 will be described. The O-ring seal 52 may be installed onto the body 32, as described above. The open end 60 of each end cap 34, 36 may be placed onto one of the corresponding ends 38, 40 of the body 32 and rotated about the body 32 in a first direction (e.g., clockwise) to threadably engage the threaded portion 70 of each end cap 34, 36 with the corresponding threaded portion 46 of the body 32. As the end caps 34, 36 are rotated about the body 32, the O-ring seals 52 may be compressed to form a seal therebetween. The end caps 34, 36 may be rotated about the body 32 in the first direction until the alignment orifices 76 of the alignment feature 72 are coaxially aligned with the corresponding alignment orifices 48 extending through the outer surface 42 of the body 32. The fastener 78 may engage each of the aligned orifice 76, 48 to restrict or prevent separation of the end caps 34, 36 from the body 32.

It should be understood that both end caps 34, 36 may be assembled onto the body 32 simultaneously, or first end cap 34 may be assembled onto the body 32 before or after the second end cap 36 is assembled onto the body 32. Furthermore, the bearing-housing assemblies 24, 26, the motor assembly 28, the compression mechanism 30, and/or any of the other components of the compressor 20 may be installed into the body 32 before one or both of the end cap 34, 36 are assembled onto the body 32.

Disassembly of the compressor shell assembly 22 may be accomplished by removing the fasteners 78 from each of the aligned orifices 48, 76. The end caps 34, 36 may then be rotated about the body 32 in a second direction (e.g. counterclockwise) until the threaded portions 70 of the end caps 34, 36 disengage from the corresponding threaded portions 46 of the body 32. The end caps 34, 36 may then be separated from the body 32. It should be understood that although both end caps 34, 36 were described as being disassembled from the body 32 simultaneously, the first end cap 34 may be disassembled from the body 32 before or after the second end cap 36 is disassembled from the body 32.

Figure 3:
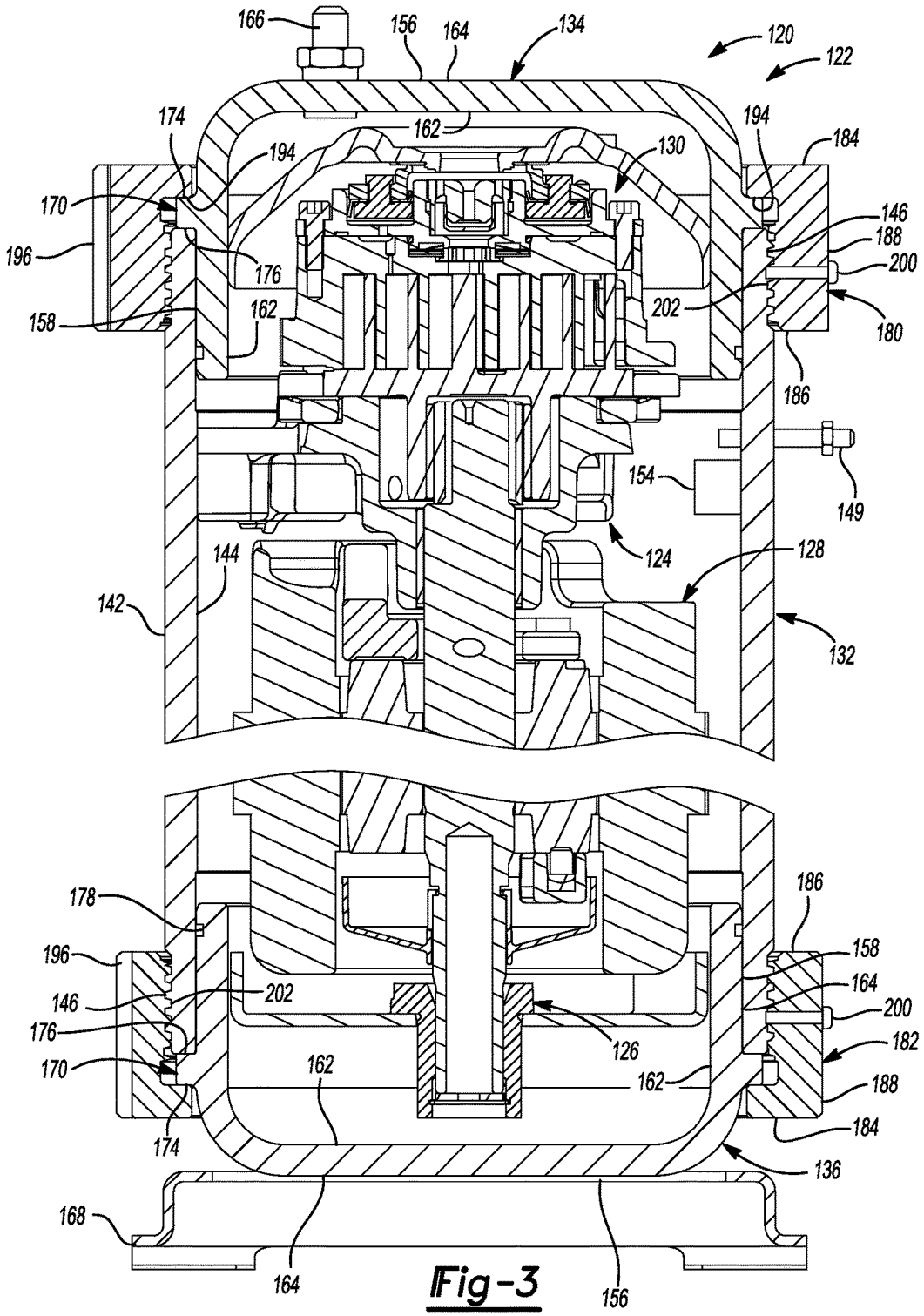
FIG. 3 is a cross-sectional view of another compressor including another compressor shell assembly according to the principles of the present disclosure.

With reference to FIG. 3, another compressor 120 is provided that may include a compressor shell assembly 122, first and second bearing-housing assemblies 124, 126, a motor assembly 128, and a compression mechanism 130. The structures and/or functions of the bearing-housing assemblies 124, 126, the motor assembly 128, and the compression mechanism 130 may be similar or identical to that of the bearing housing assemblies 24, 26, the motor assembly 28, and the compression mechanism 30 described above, and therefore, will not be described again in detail. It will be appreciated that, like the compressor 20 described above, the compressor 120 may be any type of compressor, such as a scroll compressor, a reciprocating compressor, a rotary-vane compressor, a centrifugal compressor, or an axial compressor, for example.

The compressor shell assembly 122 may form a compressor housing and may contain therein the first and second bearing-housing assemblies 124, 126, the motor assembly 128, and the compression mechanism 130. The compressor shell assembly 122 may include a body 132, a first end cap 134, a second end cap 136, a first collar or lock nut 180, and a second collar or lock nut 182.

Figure 4:
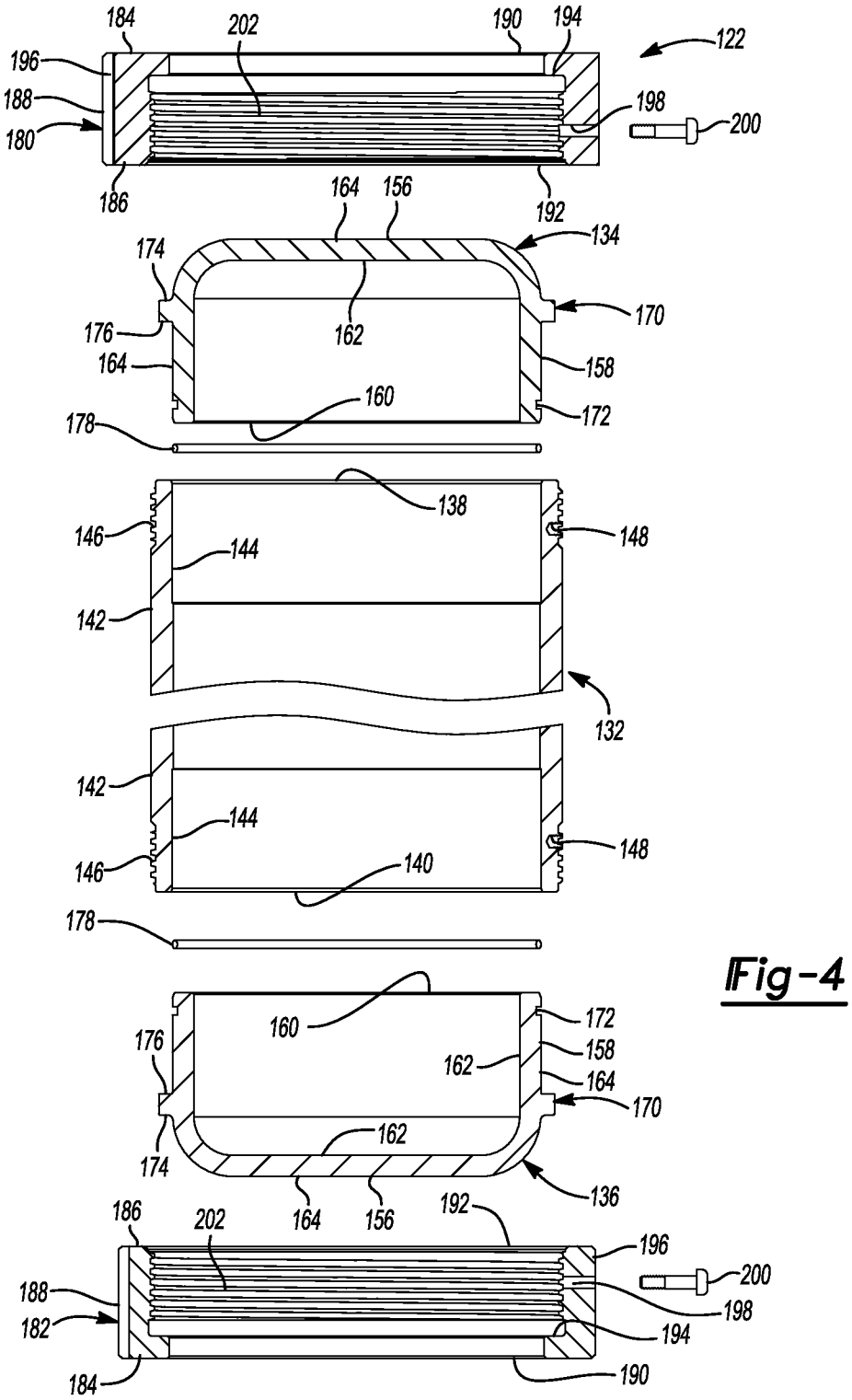
FIG. 4 is an exploded cross-sectional view of the compressor shell assembly of FIG. 3.

Referring now to FIGS. 3 and 4, the body 132 may be an annular member and may include a first end 138, a second end 140, and outer and inner surfaces 142, 144 extending longitudinally between the first and second ends 138, 140. The outer surface 142 of the body 132 may include a pair of threaded portions 146, at least one pair of alignment orifices 148, and an inlet fitting 149. Each threaded portion 146 may be located near a respective one of the ends 138, 140. Each alignment orifice 148 may be located near a respective one of the threaded portions 146 and may extend through the outer surface 142 of the body 132. The structure and/or function of the inlet fitting 149 may be similar or identical to the inlet fitting 49 described above, and therefore, will not be described again in detail. The inner surface 144 of the body 132 may include features 154 (shown schematically in FIG. 3) that may be may be similar or identical to the features 54 described above, and therefore, will also not be described again in detail.

The first and the second end caps 134, 136 may each include a first wall 156 closing an end of an annular side wall 158. Each wall 156, 158 may include inner and outer surfaces 162, 164. An open end 160, generally defined by the annular side wall 158, may be located opposite the inner surface 162 of each first wall 156.

The first wall 156 of the first end cap 134 may include a discharge fitting 166 and the first wall 156 of the second end cap 136 may include a base 168. The structures and/or functions of the discharge fitting 166 and the base 168 may be similar or identical to the discharge fitting 66 and the base 68 described above, respectively, and therefore, will not be described again in detail.

The side wall 158 of each end cap 134, 136 may include an outwardly extending annular protrusion 170 having a first surface 174 and an oppositely located second surface 176. An annular groove 172 may be located along the outer surface 164 of the side wall 158 and may receive therein an elastomeric annular gasket or O-ring seal 178.

Each of the first and second lock nuts 180, 182 may include a first surface 184 having first aperture 190 extending in a direction towards a second surface 186. The second surface 186 may have a second aperture 192 extending in a direction towards the first surface 184. A shoulder 194 may be formed at the intersection of the first and second apertures 190, 192. In this manner, the first aperture 190 includes a smaller diameter than the second aperture 192. The second aperture 192 may include a threaded portion 202 that may matingly engage the threaded portions 146 of the body 132.

A side surface 188 may extend between the first and second surfaces 184, 186 of each lock nut 180, 182 and may include a series of radially disposed flats 196 and at least one alignment orifice 198. The alignment orifice 198 may extend through the side surface 188 and may be near or equivalent in size to the alignment orifices 148 disposed through the outer surface 142 of the body 132. Fasteners 200, such as bolts or screws, for example, may extend through the alignment orifices 198 and engage the alignment orifices 148.

With continued reference to FIGS. 3 and 4, assembly of the compressor shell assembly 122 will be described. The O-ring seal 178 may be installed into the groove 172 located on the side wall 158 of each end cap 134, 136. The open end 160 of each end cap 134, 136 may be inserted into one of the corresponding ends 138, 140 of the body 132 until the second surface 176 of the protrusion abuts the corresponding end 138, 140 of the body 132. Each lock nut 180, 182 may be placed around the side wall 158 of a respective one of the end caps 134, 136 such that the shoulder 194 faces the first surface 174 of the corresponding protrusion 170. The flats 196 of the lock nuts 180, 182 may be gripped to help rotate the lock nuts 180, 182 around the body 132 in a first direction (e.g. clockwise) until the threaded portions 202 of the lock nuts 180, 182 matingly engage the corresponding threaded portions 146 of the body 132 and the shoulder 194 contacts the first surface 174 of the corresponding protrusion 170. Once the alignment orifices 198 extending through each of the side surfaces 188 of the lock nuts 180, 182 are coaxially aligned with the corresponding alignment orifices 148 disposed through the outer surface 142 of the body 132, the fastener 200 may engage the aligned offices 198, 148 to restrict or prevent separation of the lock nuts 180, 182 and end caps 134, 136 from the body 132.

It should be understood that both end caps 134, 136 and both lock nuts 180, 182 may be assembled onto the body 132 simultaneously or the first end cap 134 and the first lock nut 180 may be assembled onto the body 132 before or after the second end cap 136 and the second lock nut 182 are assembled onto the body 132. Furthermore, the bearing-housing assemblies 124, 126, the motor assembly 128, the compression mechanism 130, and/or any of the other components of the compressor 120 may be installed within the body 132 before one or both of the end cap 134, 136 and lock nuts 180 182 are assembled to the body 132.

Disassembly of the compressor shell assembly 122 may be accomplished by removing the fasteners 200 from the aligned orifices 148, 198. The flats 196 of the lock nuts 180, 182 may be gripped to help rotate the lock nuts 180, 182 around the body 132 in a second direction (e.g. counter-clockwise) until the threaded portions 202 of the lock nuts 180, 182 disengage from the corresponding threaded portions 146 of the body 132. The lock nuts 180, 182 and the end caps 134, 136 may be separated from the body 132.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically illustrated or described. The same may also be varied in many ways. Such variations are not to be regarded as a departure from the disclosure, and all such modifications are intended to be included within the scope of the disclosure.

What is claimed is:

1. A compressor comprising:

a compression mechanism; and a shell assembly housing said compression mechanism and including a body, an end cap, and an alignment feature, said end cap including a first threaded portion disposed on an inner surface of said end cap and threadably engaging a second threaded portion disposed on an outer surface of said body, wherein said alignment feature is an annular collar extending from an outer surface of said end cap and contacting said outer surface of said body.

2. The compressor of claim 1, wherein said outer surface of said body extends between first and second ends of said body, and wherein a fastener engages said collar and a first aperture disposed through said outer surface.

3. The compressor of claim 2, wherein said collar is integrally formed with said end cap and includes a second aperture through which said fastener extends.

4. The compressor of claim 1, wherein said end cap includes an outer wall having a discharge fitting extending therethrough.

5. A compressor comprising:

a compression mechanism; and a shell assembly housing said compression mechanism and including a body, an end cap, and a collar, said end cap engaging said body and said collar restricting separation of said end cap and said body, wherein said body includes outer and inner surfaces extending between first and second ends of said body, and wherein a fastener engages said collar and a first aperture disposed through said outer surface, and wherein said end cap includes a first threaded portion matingly engaging a second threaded portion disposed on said outer surface of said body.

6. The compressor of claim 5, wherein said collar is integrally formed with said end cap and includes a second aperture through which said fastener extends.

7. The compressor of claim 5, wherein an O-ring seal is disposed between said end cap and said body.

8. A compressor comprising:

a compression mechanism; and a shell assembly housing said compression mechanism and including a body, an end cap, and a collar, said end cap engaging said body and said collar restricting separation of said end cap and said body, wherein said body includes outer and inner surfaces extending between first and second ends of said body, and wherein a fastener engages said collar and a first aperture disposed through said outer surface, wherein said collar includes a shoulder engaging said end cap and a threaded portion engaging a threaded portion disposed on said outer surface of said body, and wherein said collar includes a second aperture, said fastener engaging said second aperture of said collar and said first aperture disposed through said outer surface of said body.

9. The compressor of claim 8, wherein said end cap includes an annular protrusion having a first surface and an oppositely located second surface, said shoulder of said collar engages said first surface, and said second surface engages said first end of said body.

10. The compressor of claim 9, wherein said end cap includes a side surface partially received within said first end of said body, said annular protrusion extending radially outward from said side surface.

11. The compressor of claim 10, wherein said side surface includes an annular groove receiving an O-ring seal therein.

12. A compressor comprising: a compression mechanism; and a shell assembly including a body, a first alignment feature, and first and second end caps cooperating to contain said compression mechanism within said body, said body includes first and second open ends and inner and outer surfaces extending between said first and second ends, said outer surface includes first and second threaded portions disposed near said first and second ends, respectively, said first end cap includes a side wall having a third threaded portion engaging said first threaded portion of said body, said second end cap includes a side wall having a fourth threaded portion engaging said second threaded portion of said body.

13. The compressor of claim 12, wherein said side wall of said first end cap includes a first aperture, said outer surface of said body includes a second aperture disposed near said first end, and wherein a first fastener engages said first and second apertures, said side wall of said second end cap includes a third aperture, said outer surface of said body includes a fourth aperture disposed near said second end, and wherein a second fastener engages said third and fourth apertures.

14. The compressor of claim 12, wherein said first alignment feature is a first collar, wherein said shell assembly includes a second collar and first and second fasteners, said first collar coupled to said side wall of said first end cap and includes a first aperture, said outer surface of said body includes a second aperture disposed near said first end, and wherein said first fastener engages said first and second apertures, said second collar coupled to said side wall of said second end cap and includes a third aperture, said outer surface of said body includes a fourth aperture disposed near said second end, and wherein said second fastener engages said third and fourth apertures.

15. The compressor of claim 12, wherein said shell assembly includes a first O-ring seal disposed between said first end cap and said body and a second O-ring seal disposed between said second end cap and said body.

16. The compressor of claim 12, wherein said first end cap includes an outer wall having a discharge fitting extending therethrough, and said second end cap includes an outer wall having a mounting base.

17. The compressor of claim 12, wherein said shell assembly includes a second alignment feature, said first and second alignment features are first and second annular collars, respectively, wherein said first annular collar extends from an outer surface of said first end cap and contacts said outer surface of said body, and wherein said second annular collar extends from an outer surface of said second end cap and contacts said outer surface of said body.

18. A compressor comprising:

a compression mechanism; and a shell assembly including a body, first and second end caps, and first and second lock nuts cooperating with said first and second end caps to contain said compression mechanism within said body, said body includes first and second open ends and inner and outer surfaces extending between said first and second open ends, said outer surface includes a first threaded portion disposed near said first end and a second threaded portion disposed near said second end, said first end cap includes a side wall received within said first end of said body and having a first protrusion engaging said first end, said first lock nut includes a first shoulder engaging said first protrusion of said first end cap and a third threaded portion engaging said first threaded portion of said body, said second end cap includes a side wall received within said second end of said body and having a second protrusion engaging said second end, said second lock nut includes a second shoulder engaging said second protrusion of said second end cap and a fourth threaded portion engaging said second threaded portion of said body.

19. The compressor of said claim 18, wherein said side wall of said first and second end caps includes outer surfaces engaging said inner surfaces of said body, said outer surfaces of said first and second end caps includes grooves receiving O-ring seals therein.

20. The compressor of said claim 18, wherein said shell assembly includes first and second fasteners, said first lock nut includes a first aperture, said outer surface of said body includes a second aperture, said first fastener engaging said first and second apertures, said second lock nut includes a third aperture, said outer surface of said body includes a fourth aperture, said second fastener engaging said third and fourth apertures.

21. The compressor of claim 18, wherein said first end cap includes an outer wall having a discharge fitting extending therethrough, and said second end cap includes an outer wall having a mounting base.

* * * * *